US011035247B2

(12) United States Patent
Hafner et al.

(10) Patent No.: US 11,035,247 B2
(45) Date of Patent: Jun. 15, 2021

(54) TURBINE APPARATUS AND METHOD FOR REDUNDANT COOLING OF A TURBINE APPARATUS

(71) Applicant: GENERAL ELECTRIC COMPANY, Schenectady, NY (US)

(72) Inventors: Matthew Troy Hafner, Honea Path, SC (US); Scott Francis Johnson, Simpsonville, SC (US); James Joseph Murray, Piedmont, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 985 days.

(21) Appl. No.: 15/088,768

(22) Filed: Apr. 1, 2016

(65) Prior Publication Data

US 2017/0284222 A1 Oct. 5, 2017

(51) Int. Cl.

| | |
|---|---|
| ***F01D 25/12*** | (2006.01) |
| ***F01D 11/08*** | (2006.01) |
| ***F01D 25/24*** | (2006.01) |

(52) U.S. Cl.

CPC ..... *F01D 25/12* (2013.01); *F01D 11/08* (2013.01); *F01D 25/24* (2013.01); (Continued)

(58) Field of Classification Search

CPC ..... F01D 25/14; F01D 25/24; F01D 11/24

See application file for complete search history.

(56) References Cited

U.S. PATENT DOCUMENTS 3,584,972 A * 6/1971 Bratkovich ..... B21D 53/78 416/229 R
4,280,792 A * 7/1981 Hartel ..... F01D 11/08 165/169

(Continued)

FOREIGN PATENT DOCUMENTS

EP 0694677 A1 1/1996
EP 2381070 A2 10/2011

(Continued)

OTHER PUBLICATIONS

European Search Report issued for Application No. 17162734.2 dated Sep. 20, 2017.

(Continued)

*Primary Examiner* — J. Todd Newton
*Assistant Examiner* — Cameron A Corday
(74) *Attorney, Agent, or Firm* — McNees Wallace & Nurick LLC

(57) ABSTRACT

A turbine apparatus is disclosed including a first article and a second article disposed between the first article and a hot gas path of a turbine. The first article includes at least one first article cooling channel in fluid communication with and downstream from a cooling fluid source, and the second article includes at least one second article cooling channel in fluid communication with and downstream from the at least one first article cooling channel. A method for redundant cooling of the turbine apparatus is disclosed including flowing a cooling fluid from the cooling fluid source through at least one first article cooling channel, exhausting the cooling fluid from the at least one first article cooling channel into at least one second article cooling channel, and flowing the cooling fluid through the at least one second article cooling channel.

20 Claims, 4 Drawing Sheets

(52) U.S. Cl.
CPC ..... *F05D 2220/32* (2013.01); *F05D 2240/11* (2013.01); *F05D 2260/202* (2013.01); *F05D 2260/205* (2013.01); *F05D 2260/213* (2013.01); *F05D 2260/84* (2013.01); *F05D 2300/13* (2013.01); *F05D 2300/175* (2013.01); *F05D 2300/2112* (2013.01); *F05D 2300/2261* (2013.01); *F05D 2300/6033* (2013.01)

(56) References Cited

U.S. PATENT DOCUMENTS

| | | | | |
|---|---|---|---|---|
| 6,390,769 | B1 * | 5/2002 | Burdgick | F01D 9/04 415/116 |
| 6,391,052 | B2 | 5/2002 | Buirge et al. | |
| 6,627,019 | B2 * | 9/2003 | Jarmon | C04B 35/806 156/89.11 |
| 6,746,755 | B2 | 6/2004 | Morrison et al. | |
| 6,942,445 | B2 * | 9/2005 | Morris | F01D 9/04 415/1 |
| 7,255,535 | B2 | 8/2007 | Albrecht et al. | |
| 8,257,017 | B2 * | 9/2012 | Down | F01D 11/24 415/1 |
| 8,257,809 | B2 | 9/2012 | Morrison et al. | |
| 10,400,627 | B2 * | 9/2019 | Ning | F01D 5/187 |
| 2004/0047726 | A1 | 3/2004 | Morrison | |
| 2008/0199661 | A1 | 8/2008 | Keller et al. | |
| 2010/0135777 | A1 | 6/2010 | Manteiga et al. | |
| 2012/0263582 | A1 * | 10/2012 | Foster | F01D 25/246 415/182.1 |
| 2013/0052008 | A1 | 2/2013 | Spangler | |
| 2013/0243575 | A1 | 9/2013 | Zelesky et al. | |
| 2014/0261986 | A1 | 9/2014 | Lazur et al. | |

FOREIGN PATENT DOCUMENTS

| | | |
|---|---|---|
| JP | 2001-317306 A | 11/2001 |
| JP | 2007-298024 A | 11/2007 |

OTHER PUBLICATIONS

Japanese Notice of Reasons for Refusal issued to related Japanese Patent Application No. 2017-062236 dated Jan. 25, 2021.

* cited by examiner

TURBINE APPARATUS AND METHOD FOR REDUNDANT COOLING OF A TURBINE APPARATUS

FIELD OF THE INVENTION

The present invention is directed to turbine apparatuses, turbine nozzles, and turbine shrouds. More particularly, the present invention is directed to turbine apparatuses, turbine nozzles, and turbine shrouds including a redundant cooling configuration.

BACKGROUND OF THE INVENTION

Gas turbines operate under extreme conditions. In order to drive efficiency higher, there have been continual developments to allow operation of gas turbines at ever higher temperatures. As the temperature of the hot gas path increases, the temperature of adjacent regions of the gas turbine necessarily increase in temperature due to thermal conduction from the hot gas path.

In order to allow higher temperature operation, some gas turbine components, such as nozzles and shrouds, have been divided such that the higher temperature regions (the fairings of the nozzles and the inner shrouds of the shrouds) may be formed from materials, such as ceramic matrix composites, which are especially suited to operation at extreme temperatures, whereas the lower temperature regions (the outside and inside walls of the nozzles and the outer shrouds of the shrouds) are made from other materials which are less suited for operation at the higher temperatures, but which may be more economical to produce and service.

Gas turbines typically operate for very long periods of time. Service intervals generally increase with time as turbines advance, but current turbines may have combustor service intervals (wherein combustion is halted so that the combustor components may be serviced, but the rotating sections are generally left in place) of 12,000 hours or more, and full service intervals (wherein all components are serviced) of 32,000 hours or more. Unscheduled service stops impose significant costs and reduce the gas turbine reliability and availability.

Incorporation of gas turbine components, such as nozzles and shrouds, which have high temperature regions and low temperature regions, may result in unscheduled service stops in the event where a high temperature portion fails (the high temperature portions being subjected to operating conditions which are more harsh than the operating conditions to which the low temperature portions are subjected), as the low temperature portions may be unable to survive in the turbine without the protection afforded by the failed high temperature portion until the next scheduled service interval.

BRIEF DESCRIPTION OF THE INVENTION

In an exemplary embodiment, a turbine apparatus includes a first article and a second article. The first article includes at least one first article cooling channel. The second article is disposed between the first article and a hot gas path of a turbine, and includes at least one second article cooling channel. The at least one first article cooling channel is in fluid communication with and downstream from a cooling fluid source, and the at least one second article cooling channel is in fluid communication with and downstream from the at least one first article cooling channel.

In another exemplary embodiment, a method for redundant cooling of a turbine apparatus includes flowing a cooling fluid from a cooling fluid source through at least one first article cooling channel disposed in a first article, exhausting the cooling fluid from the at least one first article cooling channel into at least one second article cooling channel disposed in a second article, and flowing the cooling fluid through the at least one second article cooling channel. The second article is disposed between the first article and a hot gas path of a turbine.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are gas turbine apparatuses, such as turbine nozzles and turbine shrouds. Embodiments of the present disclosure, in comparison to apparatuses and methods not utilizing one or more features disclosed herein, decrease costs, increase efficiency, improve apparatus lifetime at elevated temperatures, decrease non-scheduled service outages, increase turbine service intervals, or a combination thereof.

Figure 1:
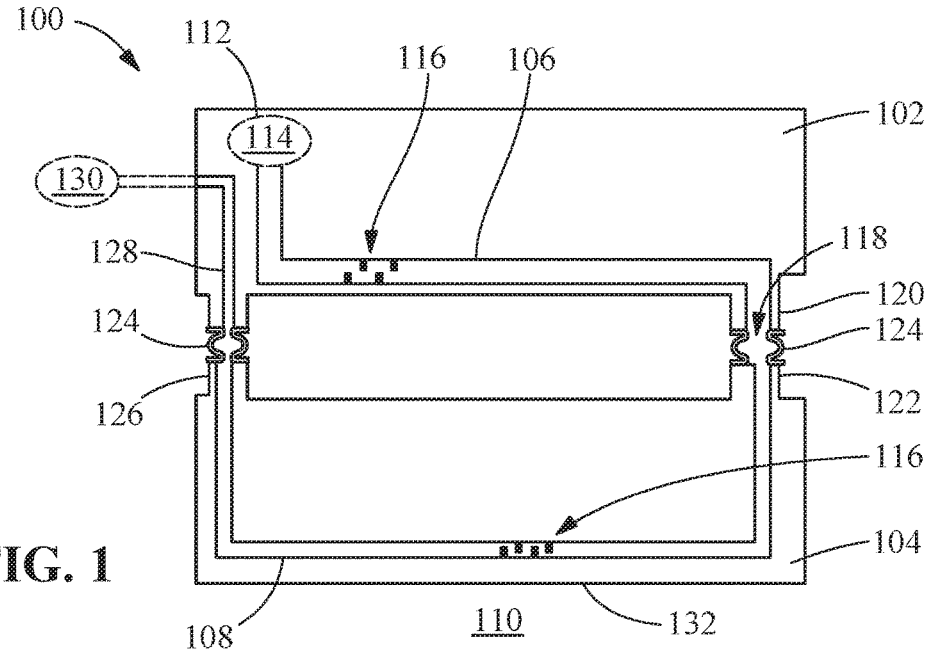
FIG. 1 is a schematic view of a turbine apparatus, according to an embodiment of the present disclosure.

Referring to FIG. 1, in one embodiment, a turbine apparatus 100 includes a first article 102 and a second article 104. The first article 102 includes at least one first article cooling channel 106. The second article 104 includes at least one second article cooling channel 108, and is disposed between the first article 102 and a hot gas path 110 of a turbine (not shown). The at least one first article cooling channel 106 is in fluid communication with and downstream from a cooling fluid source 112, and the at least one second article cooling channel 108 is in fluid communication with and downstream from the at least one first article cooling channel 106.

The first article 102 may include any suitable composition, including, but not limited to, a metallic composition. Suitable metallic compositions include, but are not limited to, a nickel-based alloy, a superalloy, a nickel-based superalloy, an iron-based alloy, a steel alloy, a stainless steel alloy, a cobalt-based alloy, a titanium alloy, or a combination thereof.

The second article 104 may include any suitable composition, including, but not limited to, a refractory metallic composition, a superalloy composition, a nickel-based superalloy composition, a cobalt-based superalloy composition, a ceramic matrix composite composition, or a combination thereof. The ceramic matrix composite composition may include, but is not limited to, a ceramic material, an aluminum oxide-fiber-reinforced aluminum oxide (Ox/Ox), carbon-fiber-reinforced carbon (C/C), carbon-fiber-reinforced silicon carbide (C/SiC), and silicon-carbide-fiber-reinforced silicon carbide (SiC/SiC).

In one embodiment, the second article 104 includes a thermal tolerance greater than a thermal tolerance of the first article 102. As used herein, "thermal tolerance" refers to the temperature at which material properties relevant to the operating of the turbine apparatus 100 are degraded to a degree beyond the useful material capability (or required capability).

The cooling fluid source 112 may be any suitable source, including, but not limited to, a turbine compressor (not shown) or an upstream turbine component (not shown). The cooling fluid source 112 may supply any suitable cooling fluid 114, including, but not limited to, air.

The first article cooling channel 106 and the second article cooling channel 108 may, independently, include any suitable cross-sectional conformation, including, but not limited to circular, elliptical, oval, triangular, quadrilateral, rectangular, square, pentagonal, irregular, or a combination thereof. The edges of the first article cooling channel 106 and the second article cooling channel 108 may, independently, be straight, curved, fluted, or a combination thereof. The first article cooling channel 106 and the second article cooling channel 108 may, independently, include turbulators 116, such as, but not limited to, pins (shown), pin banks, fins, bumps, and surface textures.

In one embodiment, the at least one first article cooling channel 106 includes a minimum first cooling fluid pressure and the at least one second article cooling channel 108 includes a second minimum cooling fluid pressure. Each of the first minimum cooling gas pressure and the second minimum cooling fluid pressure are greater than a hot gas path pressure of the hot gas path 110.

In another embodiment, the at least one second article cooling channel 108 includes a flow restrictor 118. The flow restrictor 118 restricts a flow of cooling fluid 114 through the at least one first article cooling channel 106.

In one embodiment, the at least one first article cooling channel 106 includes at least one exhaust port 120, the at least one second article cooling channel 108 includes at least one inlet 122, and the at least one exhaust port 120 is coupled to the at least one inlet 122. The flow restrictor 118 may include an inlet 122 having a narrower orifice that the exhaust port 120. The coupling of the at least one exhaust port 120 to the at least one inlet 122 may be a hermetic coupling or a non-hermetic coupling. In a further embodiment, a sealing member 124 is disposed between the at least one exhaust port 120 and the at least one inlet 122. The sealing member 124 may be any suitable seal, including, but not limited to, an elastic seal. As used herein, "elastic" refers to the property of being biased to return toward an original conformation (although not necessarily all of the way to the original conformation) following deformation, for example, by compression. Suitable elastic seals include, but are not limited to, w-seals (shown), v-seals, e-seals, c-seals, corrugated seals, spring-loaded seals, spring-loaded spline seals, spline seals, and combinations thereof.

In another embodiment, the at least one second article cooling channel 108 includes at least one outlet 126, the at least one first article 102 includes at least one recycling channel 128, and the at least one outlet 126 is coupled to the at least one recycling channel 128. The at least one recycling channel 128 may be in fluid communication with a downstream component 130.

In one embodiment, a method for redundant cooling of a turbine apparatus 100 includes flowing a cooling fluid 114 from the cooling fluid source 112 through the at least one first article cooling channel 106, exhausting the cooling fluid 114 from the at least one first article cooling channel 106 into the at least one second article cooling channel 108, and flowing the cooling fluid 114 through the at least one second article cooling channel 108. Exhausting the cooling fluid 114 may include exhausting the cooling fluid 114 from at least one exhaust port 120 of the at least one first article cooling channel 106 into the at least one inlet 122 of the at least one second article cooling channel 108.

In the event of a failure of the second article 104, flowing the cooling fluid through the at least one first article cooling channel 106 may provide sufficient cooling to maintain a surface 132 of the first article 102 proximal to the hot gas path 110 at a temperature within a thermal tolerance of the first article 102 under operating conditions of the turbine for a predetermined length of time. The predetermined length of time may be any suitable length of time, including, but not limited to, a combustor service interval or a full service interval of the turbine. Suitable combustor service intervals may be an interval of at least 10,000 hours, alternatively at least 12,000 hours, alternatively at least 16,000 hours. Suitable full service intervals may be an interval of at least 20,000 hours, alternatively at least 24,000 hours, alternatively at least 32,000 hours.

In another embodiment, the cooling fluid 114 is flowed from the at least one second article cooling channel 108 into at least one recycling channel 128. In a further embodiment, the cooling fluid 114 is flowed from the at least one recycling channel 128 to at least one downstream component 130. The flow of cooling fluid 114 may be used for any suitable purpose, including, but not limited to, cooling the at least one downstream component 130.

Figure 2A:
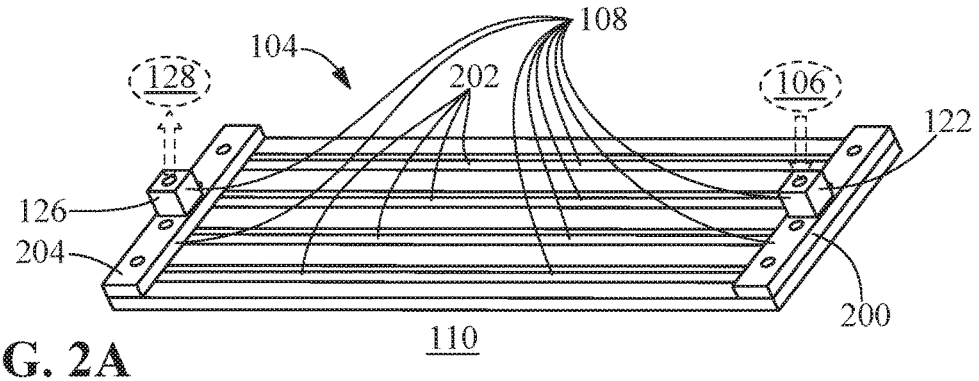
FIG. 2A is a perspective schematic view of a second portion of a turbine apparatus including a plurality of heat exchange channels, viewed from the first portion adjacent side, according to an embodiment of the present disclosure.
Figure 2B:
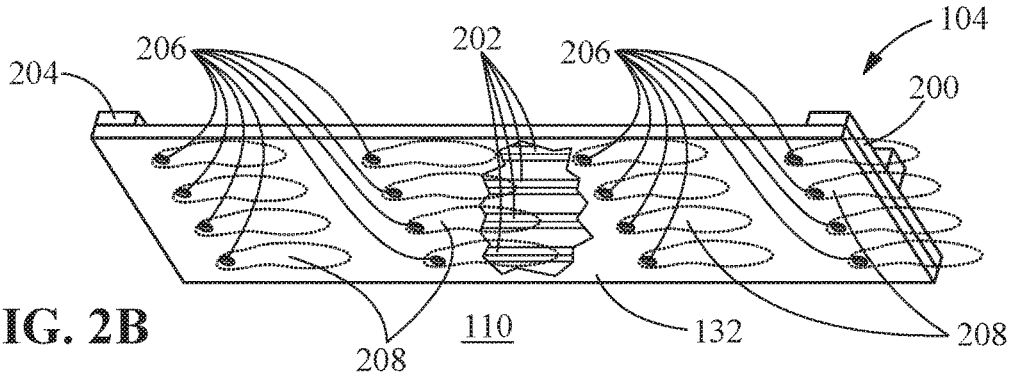
FIG. 2B is a perspective schematic view of the second portion of a turbine apparatus of FIG. 2A, viewed from the hot gas path adjacent side, according to an embodiment of the present disclosure.

Referring to FIGS. 2A and 2B, in one embodiment, the at least one second article cooling channel 108 includes a feed plenum 200 downstream from and in fluid communication with the first article cooling channel 106, and a plurality of heat exchange channels 202 downstream from and in fluid communication with the feed plenum 200. The at least one second article cooling channel 108 may further include an outlet plenum 204 downstream from and in fluid communication with the plurality of heat exchange channels 202. The at least one second article cooling channel 108 may also include, in lieu or in addition to the outlet plenum 204, and in lieu or in addition to an outlet 126 connected to a recycling channel 128, a plurality of exhaust holes 206 in fluid communication with the hot gas path 110. The plurality of exhaust holes 206 may be arranged and disposed to form a film barrier 208 between the second article 104 and the hot gas path 110. In another embodiment (not shown), the at least one first article cooling channel 106 includes a feed plenum 200 downstream from and in fluid communication with the cooling fluid source 112, and a plurality of heat exchange channels 202 downstream from and in fluid communication with the feed plenum 200. The at least one first article cooling channel 106 may further include an outlet plenum 204 downstream from and in fluid communication with the plurality of heat exchange channels 202.

Figure 3:
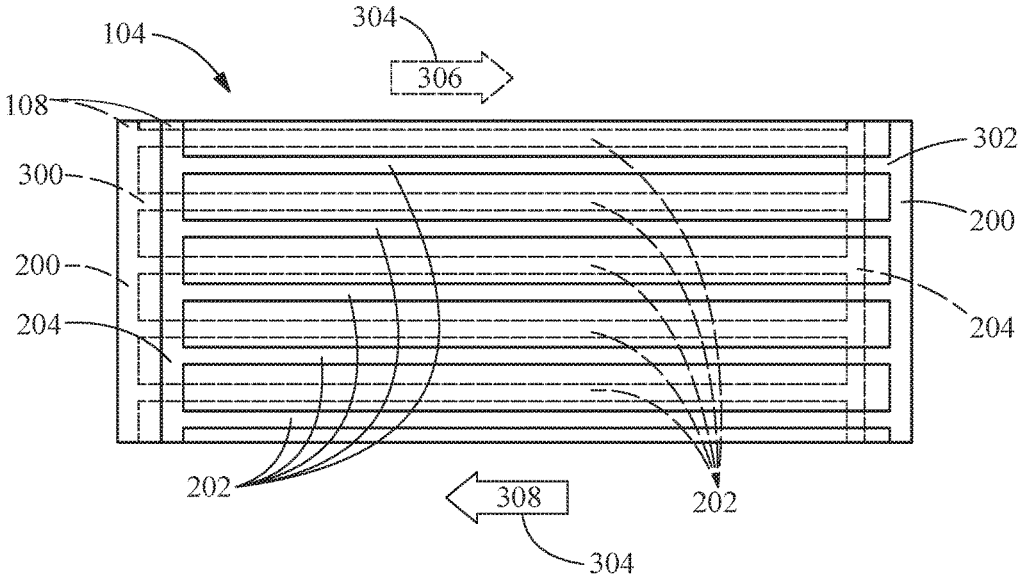
FIG. 3 is a schematic view of the second portion of a turbine apparatus including cross-flow cooling channels, according to an embodiment of the present disclosure.

Referring to FIG. 3, in one embodiment, the at least one second article cooling channel 108 includes a first cross-flow cooling channel 300 and a second cross-flow cooling channel 302. The first cross-flow cooling channel 300 includes a flow vector 304 across the second article 104 in a first direction 306, the second cross-flow cooling channel 302 includes a flow vector 304 across the second article 104 in a second direction 308, and the second direction 308 is opposite to the first direction 306. In another embodiment (not shown), the at least one first article cooling channel 106 includes a first cross-flow cooling channel 300 and a second cross-flow cooling channel 302. The first cross-flow cooling channel 300 includes a flow vector 304 across the first article 102 in a first direction 306, the second cross-flow cooling channel 302 includes a flow vector 304 across the first article 102 in a second direction 308, and the second direction 308 is opposite to the first direction 306.

Figure 4:
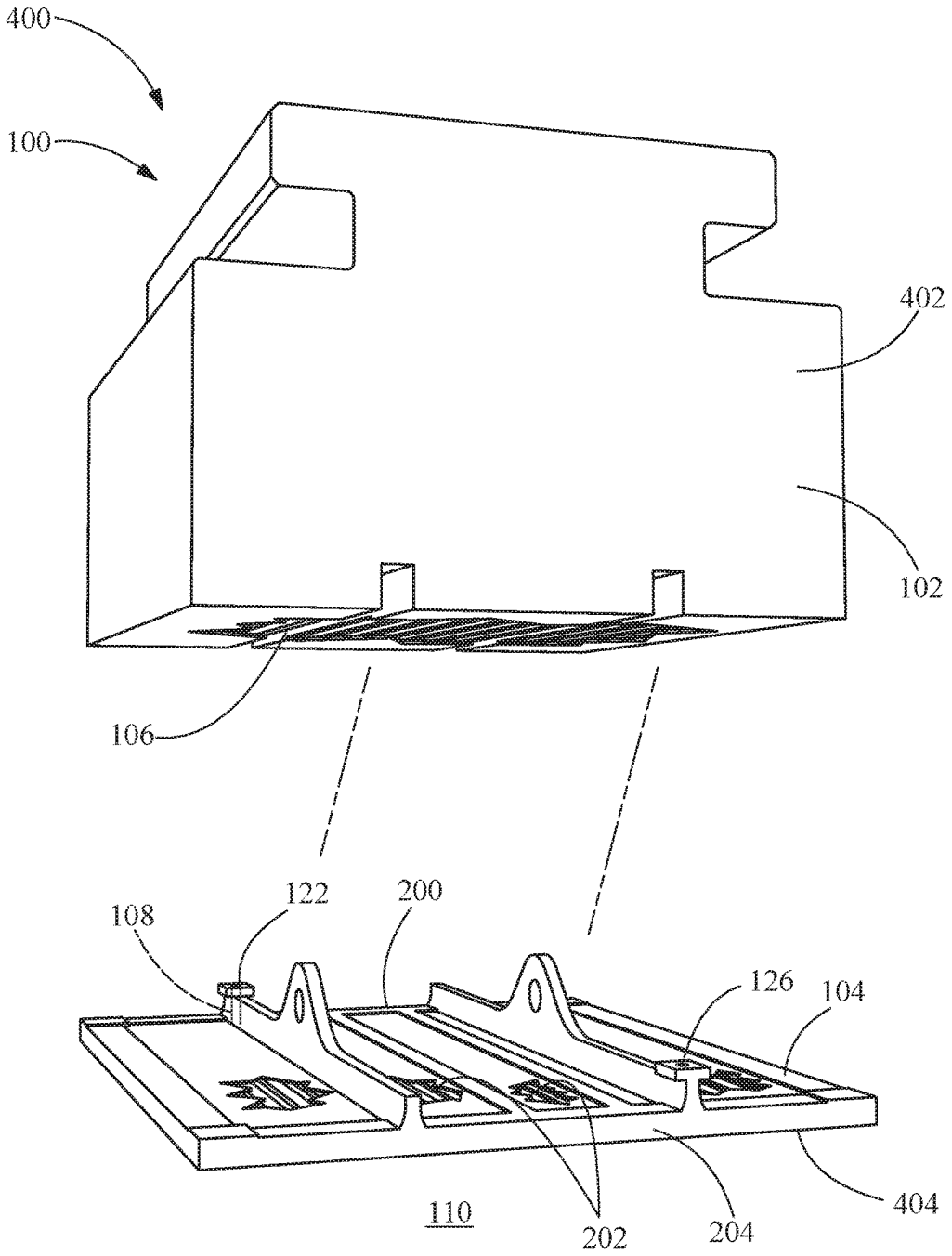
FIG. 4 is an exploded perspective view of a shroud assembly, according to an embodiment of the present disclosure.

Referring to FIG. 4, in one embodiment the turbine apparatus 100 is a shroud assembly 400, the first article 102 is an outer shroud 402, and the second article 104 is an inner shroud 404.

Figure 5:
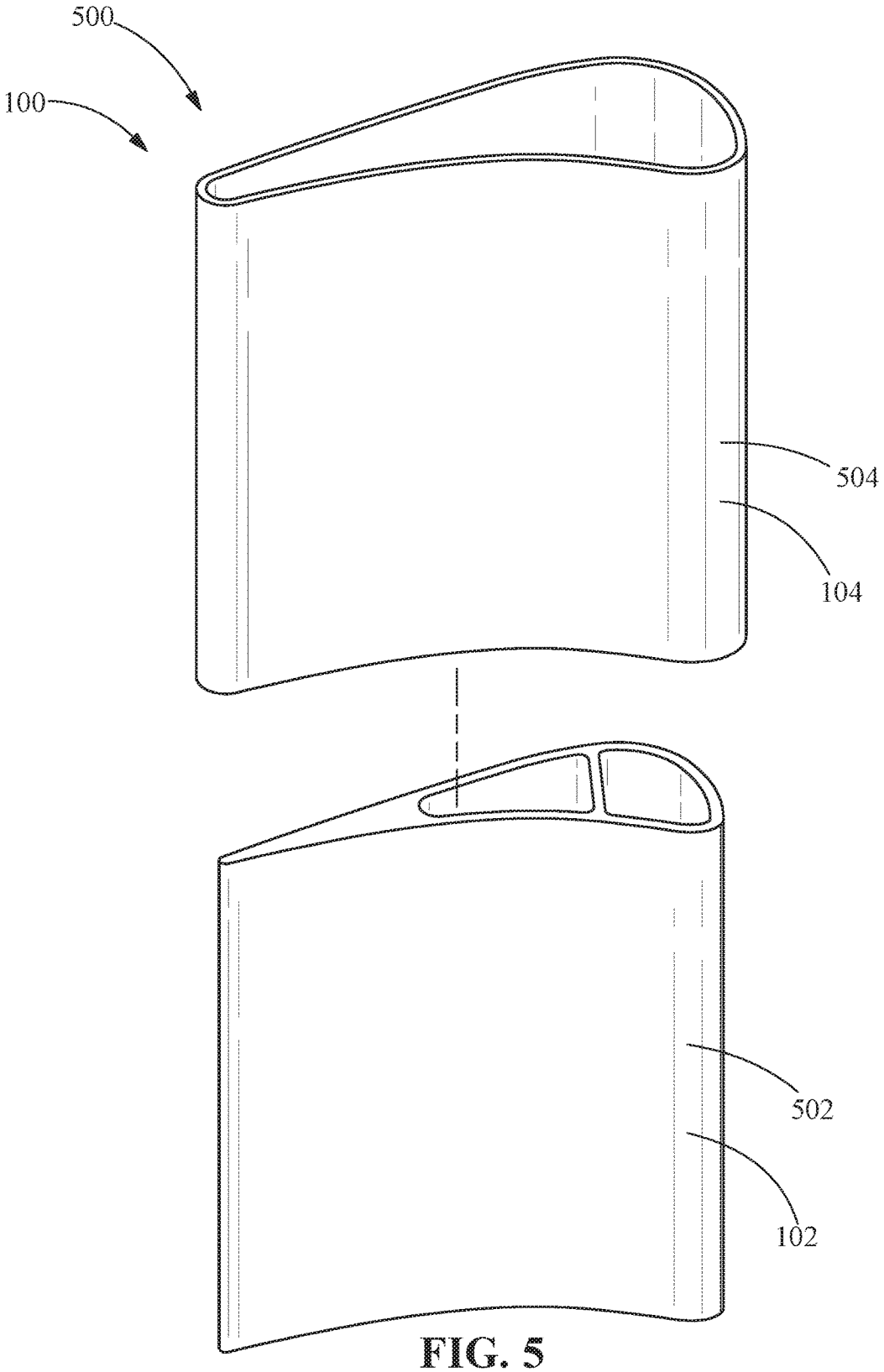
FIG. 5 is an exploded perspective view of a nozzle, according to an embodiment of the present disclosure.

Referring to FIG. 5, in another embodiment the turbine apparatus 100 is a nozzle 500, the first article 102 is a spar 502, and the second article 104 is a fairing 504.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising:

an outer shroud including at least one outer shroud cooling channel disposed within and enclosed within the outer shroud; and an inner shroud disposed between the outer shroud and a hot gas path of a turbine, the inner shroud including at least one inner shroud cooling channel disposed within and enclosed within the inner shroud, wherein the at least one outer shroud cooling channel is a cavity defined by the outer shroud, and an entire length of the at least one outer shroud cooling channel is contiguous with a radially inward facing surface of the outer shroud proximal to and facing the hot gas path, and wherein the at least one outer shroud cooling channel is in fluid communication with and downstream from a cooling fluid source, and the at least one inner shroud cooling channel is in fluid communication with and downstream from the at least one outer shroud cooling channel.

2. The turbine shroud assembly of claim 1, wherein the at least one outer shroud cooling channel includes at least one exhaust port, the at least one inner shroud cooling channel includes at least one inlet, and the at least one exhaust port is coupled to the at least one inlet.

3. The turbine shroud assembly of claim 2, further including an elastic sealing member disposed between the at least one exhaust port and the at least one inlet.

4. The turbine shroud assembly of claim 3, wherein the elastic sealing member is selected from the group consisting of a w-seal, a v-seal, an e-seal, a c-seal, a corrugated seal, a spring-loaded seal, a spring-loaded spline seal, a spline seal, and combinations thereof.

5. The turbine shroud assembly of claim 1, wherein the at least one inner shroud cooling channel includes at least one outlet, the at least one outer shroud includes at least one recycling channel, and the at least one outlet is coupled to the at least one recycling channel.

6. The turbine shroud assembly of claim 1, wherein the at least one inner shroud cooling channel includes a feed plenum downstream from and in fluid communication with the at least one outer shroud cooling channel, and a plurality of heat exchange channels downstream from and in fluid communication with the feed plenum.

7. The turbine shroud assembly of claim 6, wherein the at least one inner shroud cooling channel further includes an outlet plenum downstream from and in fluid communication with the plurality of heat exchange channels.

8. The turbine shroud assembly of claim 1, wherein the at least one inner shroud cooling channel includes a plurality of exhaust holes in fluid communication with the hot gas path, the plurality of exhaust holes being arranged and disposed to form a film barrier between the inner shroud and the hot gas path.

9. The turbine shroud assembly of claim 1, wherein the at least one inner shroud cooling channel includes a first cross-flow cooling channel and a second cross-flow cooling channel, the first cross-flow cooling channel including a flow vector across the inner shroud in a first direction, the second cross-flow cooling channel including a flow vector across the inner shroud in a second direction, the second direction being opposite to the first direction.

10. The turbine shroud assembly of claim 1, wherein the outer shroud includes a metallic composition and the inner shroud includes a ceramic matrix composite composition.

11. The turbine shroud assembly of claim 1, wherein the at least one outer shroud cooling channel includes a first minimum cooling fluid pressure and the at least one inner shroud cooling channel includes a second minimum cooling fluid pressure, each of the first minimum cooling fluid pressure and the second minimum cooling fluid pressure being greater than a hot gas path pressure of the hot gas path.

12. The turbine shroud assembly of claim 1, wherein the at least one inner shroud cooling channel includes a flow restrictor, the flow restrictor restricting a flow of cooling fluid through the at least one outer shroud cooling channel.

13. The turbine shroud apparatus of claim 1, wherein the at least one outer shroud cooling channel is arranged and disposed such that, in the event of a failure of the inner shroud, flowing a cooling fluid from the cooling fluid source through the at least one outer shroud cooling channel provides sufficient cooling to maintain the radially inward facing surface of the outer shroud proximal to and facing the hot gas path at a temperature within a thermal tolerance of the outer shroud under operating conditions of the turbine for a predetermined length of time.

14. A method for redundant cooling of a turbine apparatus, comprising:

flowing a cooling fluid from a cooling fluid source through at least one outer shroud cooling channel disposed within and enclosed within an outer shroud, the at least one outer shroud cooling channel being a cavity defined by the outer shroud wherein an entire length of the at least one outer shroud cooling channel is contiguous with a radially inward facing surface of the outer shroud proximal to and facing a hot gas path of a turbine, and;

exhausting the cooling fluid from the at least one outer shroud cooling channel into at least one inner shroud cooling channel disposed within and enclosed within an inner shroud, the inner shroud being disposed between the outer shroud and the hot gas path; and flowing the cooling fluid through the at least one inner shroud cooling channel.

15. The method of claim 14, wherein, in the event of a failure of the inner shroud, flowing the cooling fluid through the at least one outer shroud cooling channel provides sufficient cooling to maintain the radially inward facing surface of the outer shroud proximal to the hot gas path at a temperature within a thermal tolerance of the outer shroud under operating conditions of the turbine for a predetermined length of time.

16. The method of claim 14, wherein the predetermined length of time is at least 12,000 hours.

17. The method of claim 14, wherein exhausting the cooling fluid includes exhausting the cooling fluid from at least one exhaust port of the at least one outer shroud cooling channel coupled to at least one inlet of the at least one inner shroud cooling channel.

18. The method of claim 14, wherein flowing the cooling fluid from the cooling fluid source through the at least one outer shroud cooling channel disposed within and enclosed within the outer shroud includes flowing the cooling fluid through the outer shroud having a metallic composition; and wherein flowing the cooling fluid through the at least one inner shroud cooling channel includes flowing the cooling fluid through the inner shroud having a ceramic matrix composite composition.

19. The method of claim 14, further including flowing the cooling fluid from the at least one inner shroud cooling channel into at least one recycling channel disposed in the outer shroud, and flowing the cooling fluid from the at least one recycling channel to at least one downstream component, cooling the at least one downstream component.

20. A turbine nozzle, comprising:

a spar including at least one spar cooling channel disposed within and enclosed within the spar; and a fairing disposed between the spar and a hot gas path of a turbine, the fairing including at least one fairing cooling channel disposed within and enclosed within the fairing, wherein the at least one spar cooling channel is in fluid communication with and downstream from a cooling fluid source, and the at least one fairing cooling channel is in fluid communication with and downstream from the at least one spar cooling channel, wherein a portion of the at least one spar cooling channel within the spar is disposed underneath and along a surface of the spar facing the fairing such that a cooling fluid from the cooling fluid source flows through the portion of the at least one spar cooling channel within the spar and underneath the surface of the spar facing the fairing along the surface of the spar facing the fairing, cooling the surface of the spar facing the fairing, and wherein a portion of the at least one fairing cooling channel within the fairing is disposed along a surface of the fairing facing the hot gas path such that the cooling fluid from the cooling fluid source flows through the portion of the at least one fairing cooling channel along the surface of the fairing facing the hot gas path, cooling the surface of the fairing facing the hot gas path.

* * * * *